US005791257A

United States Patent [19]

Konop

[11] Patent Number: 5,791,257

[45] Date of Patent: Aug. 11, 1998

[54] OVERHEAD CRANE WITH ADJUSTABLE BEARINGS

[75] Inventor: Jeffrey A. Konop, Grafton, Wis.

[73] Assignee: Harnischfeger Corporation, St. Francis, Wis.

[21] Appl. No.: 780,639

[22] Filed: Jan. 8, 1997

[51] Int. Cl.[6] ..... B61F 15/00

[52] U.S. Cl. ..... 105/163.1; 105/218.1; 105/220; 280/43; 305/116; 295/42.1

[58] Field of Search ..... 105/163.1, 163.2, 105/170, 169, 180, 218.1, 220; 180/299, 906; 280/43; 16/19; 305/116, 138; 295/36.1, 37, 42.1

[56] References Cited

U.S. PATENT DOCUMENTS

| | | | |
|---|---|---|---|
| 1,375,536 | 4/1921 | Ostrander | 16/19 |
| 2,581,298 | 1/1952 | Roe | 16/19 |
| 3,334,911 | 8/1967 | Enters | 280/43 |
| 3,670,357 | 6/1972 | Steigerwald | 16/19 |
| 4,603,868 | 8/1986 | Schutz | 280/43 |
| 4,653,968 | 3/1987 | Rapata et al. | 16/19 |
| 4,773,691 | 9/1988 | Bernd et al. | 105/163.1 |
| 5,056,671 | 10/1991 | Thorsen | 105/163.2 |
| 5,366,232 | 11/1994 | Pozzobon et al. | 280/43 |

FOREIGN PATENT DOCUMENTS

| | | |
|---|---|---|
| 0626336 | 5/1994 | European Pat. Off. . |
| 203892 | 12/1981 | German Dem. Rep. . |
| 7712358 | 8/1977 | Germany . |
| 1191868 | 8/1968 | United Kingdom . |
| 2245664 | 6/1991 | United Kingdom . |

*Primary Examiner*—Mark T. Le
*Attorney, Agent, or Firm*—Michael Best & Friedrich LLP

[57] ABSTRACT

An overhead crane adapted to be supported on a pair of spaced apart, generally parallel first and second rails, the crane having a frame having opposite first and second ends, a first wheel rotatably mounted on the first end of the frame, the first wheel being adapted to roll along the first rail, a second wheel rotatably mounted on the second end of the frame, the second wheel being adapted to roll along the second rail, a first bearing assembly supporting the first wheel, a second bearing assembly supporting the second wheel, each of the first and second bearing assemblies including a bearing supporting the associated wheel for rotation relative to the frame about a rotation axis, the rotation axis having a position relative to the frame, and a mechanism connecting the bearing to the frame and allowing the bearing to be fixed in various positions relative to the frame, a hoist supported by the frame, and a load engaging mechanism which is raised and lowered by the hoist.

25 Claims, 4 Drawing Sheets

14
16
18
22
26
30
34
36
40
46
50
56
60
72
76
80
84
88
92
96
132
140
$d_1$
$d_2$
$d_3$

OVERHEAD CRANE WITH ADJUSTABLE BEARINGS

BACKGROUND OF THE INVENTION

Overhead cranes which travel on wheels along spaced apart, generally parallel rails are subject to the continuous problem of the skewing of the crane on the rails. Standard capsule bearing wheel assemblies for overhead cranes provide no means for alignment adjustment. If misalignment occurs as a result of damage to the end truck, it is very difficult to realign the wheel with the standard wheel assembly components. Misaligned wheels on a crane bridge can cause serious tracking problems that can result in progressive damage to the crane and to the building runway.

A typical prior art crane wheel 1 is illustrated in FIG. 1. The wheel is mounted on an axle 2 having a rotation axis 3. The axle 2 is supported relative to the frame by two capsule bearings 4. Each capsule bearing 4 includes an inner member or sleeve 5 fixed to the axle 2. The inner member 5 includes an outer surface portion 6 defining part of a sphere centered on the rotation axis 3 of the axle 2. An outer member 7 surrounds the inner member 5, has a cylindrical outer surface 8, and is housed in a cylindrical opening in the frame or end truck. Rollers 9 between the outer member 7 and the surface portion 6 of the inner member 5 allow rotation of the inner member 5 and thus of the axle 2 within the outer member 7. The outer member 7 has thereon a radially outwardly extending flange 10 which has therein a plurality of holes 11, and a respective fastener, such as a bolt or screw 12, extends through each hole 11 and into the frame to fixedly secure the bearing 4 to the frame. Lock washers 13 are used between the bolt heads and the bearing flange.

SUMMARY OF THE INVENTION

The invention provides a bearing arrangement that allows adjustment of the alignment of overhead crane wheels. As a result, in the event of misalignment, it is relatively easy to realign the wheels. Preferably, the bearing arrangement of the invention is a relatively simple modification of a standard capsule bearing arrangement. Thus, existing cranes can be easily retrofitted with the bearing arrangement of the invention.

More particularly, the invention provides a bearing assembly including a bearing supporting a wheel for rotation relative to the frame about a rotation axis, and mounting means for mounting the bearing on the frame so that the position of the rotation axis is adjustable relative to the frame. Alternatively, the bearing assembly includes a mechanism connecting the bearing to the frame and allowing the bearing to be fixed in various positions relative to the frame. In the preferred embodiment of the invention, the frame has therein a cylindrical opening, and a sleeve is housed in the frame opening, the sleeve having therein an eccentric opening housing the bearing, such that rotation of the sleeve relative to the frame moves the rotation axis relative to the frame. A hand tool, such as a spanner wrench, can be used to rotate the sleeve relative to the frame. Set screws can be used to releaseably secure the sleeve relative to the bearing.

The use of an eccentric sleeve enables relocation of a wheel bearing without expensive and difficult repairs to a damaged end truck. By rotating the eccentric sleeve, the center of a bearing moves with respect to the center of the end truck bore. This also moves the axle and the wheel in the horizontal plane, which is the critical adjustment required to align a crane wheel for proper tracking.

Other features and advantages of the invention will become apparent to those skilled in the art upon review of the following detailed description, claims and drawings.

Figure 1:
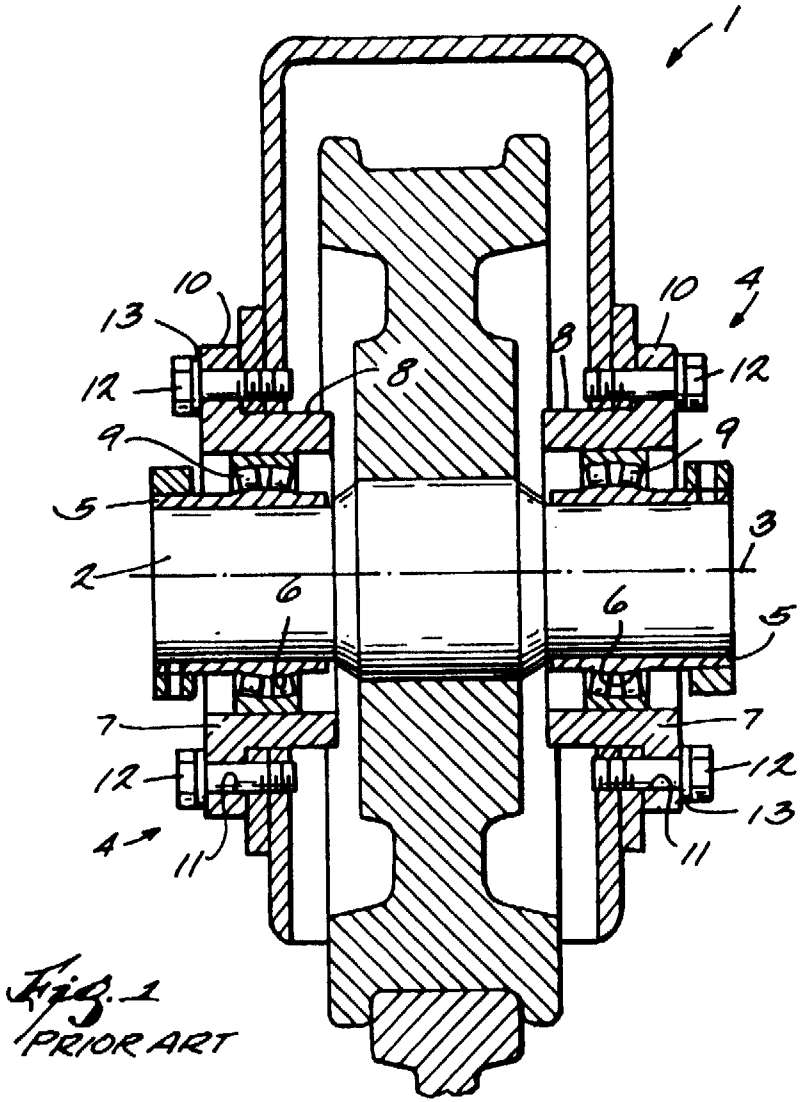
Fig. 1 PRIOR ART
FIG. 1 is a vertical sectional view of a prior art wheel assembly.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

An overhead crane 14 embodying the invention is shown in the drawings. The crane 14 comprises (see FIG. 2) a frame 16 including a pair of bridge cross-members 18 and 22, and trucks 26 and 30 at opposite ends of the cross-members 18 and 22. An operator's cab 34 is suspended from the frame 16. Drive wheels 36 and 40 are respectively rotatably mounted on the trucks 26 and 30 in engagement with rails 46 and 50, respectively, so that the rails support the crane 14. Additional non-driven or idler wheels 56 and 60 are respectively rotatably mounted on the trucks 26 and 30 in engagement with the rails 46 and 50, respectively, for further support of the crane 14. The manner in which the wheels 36, 40, 56 and 60 are mounted on the trucks 26 and 30 is described below. The rails 46 and 50 are mounted on beams or other suitable foundation means. The rotatable engagement of the drive and idler wheels with the rails permits travel of the crane 14 along the rails. Motor means 72 is mounted on the frame 16 and drives the wheels 36 and 40. In the illustrated construction, the motor means 72 includes motors 76 and 80 drivingly connected to the wheels 36 and 40, respectively. In alternative constructions (not shown), the motor means 72 could include a single motor connected to both of the wheels 36 and 40. A hoist 84 having a load hook 88 is supported for travel on tracks 92 and 96 which are respectively mounted on the cross-members 18 and 22 of the crane 14. The hoist 84 also includes motors (not shown) for moving the hoist along the tracks and for raising and lowering the load hook 88. The crane 14 may be operated by well-known controls, not shown, which control the operation of the motors 76 and 80, the movement of the hoist on the tracks, and the raising and lowering of the load hook 88.

Figure 3:
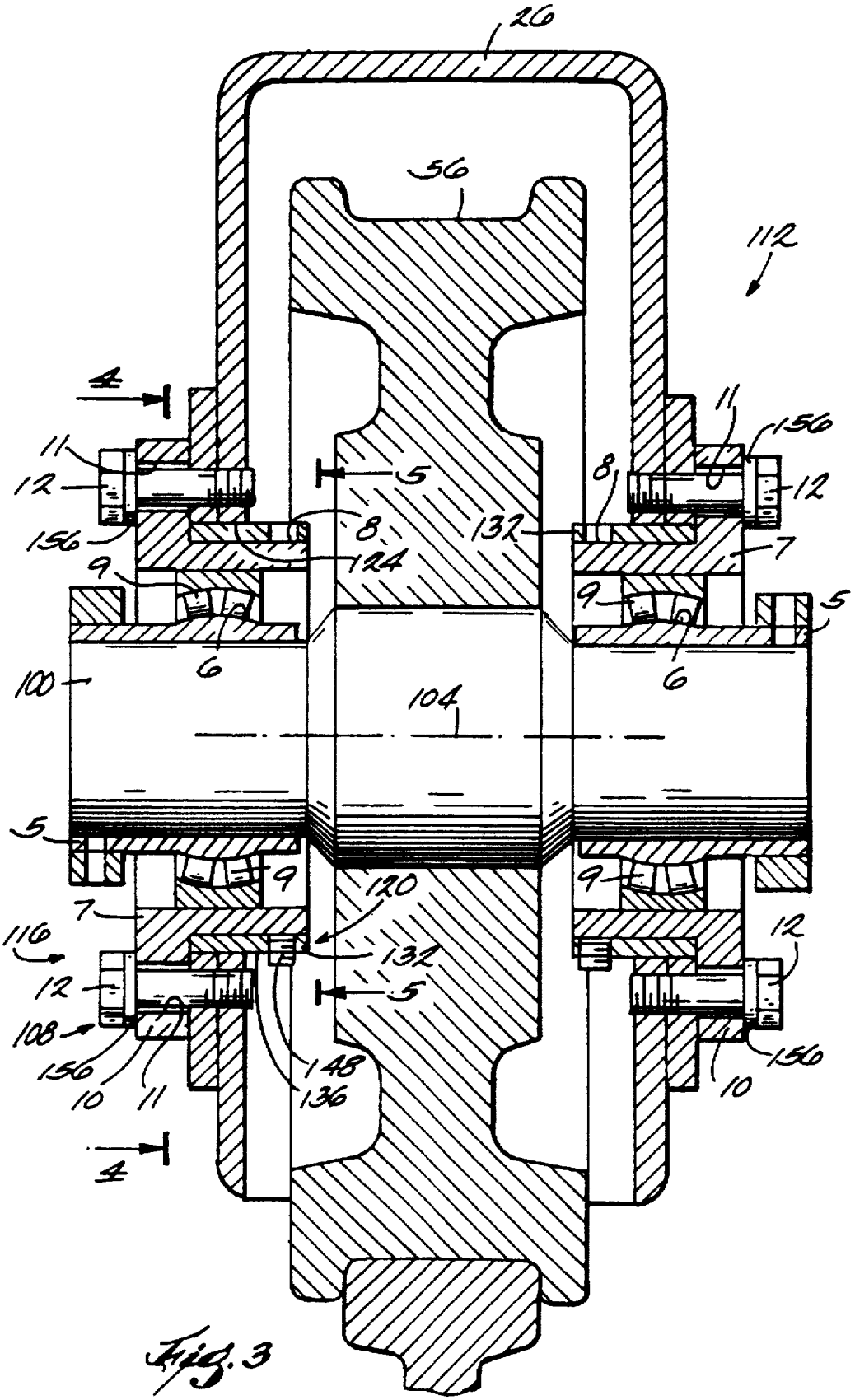
FIG. 3 is a vertical sectional view of a wheel assembly.
Figure 4:
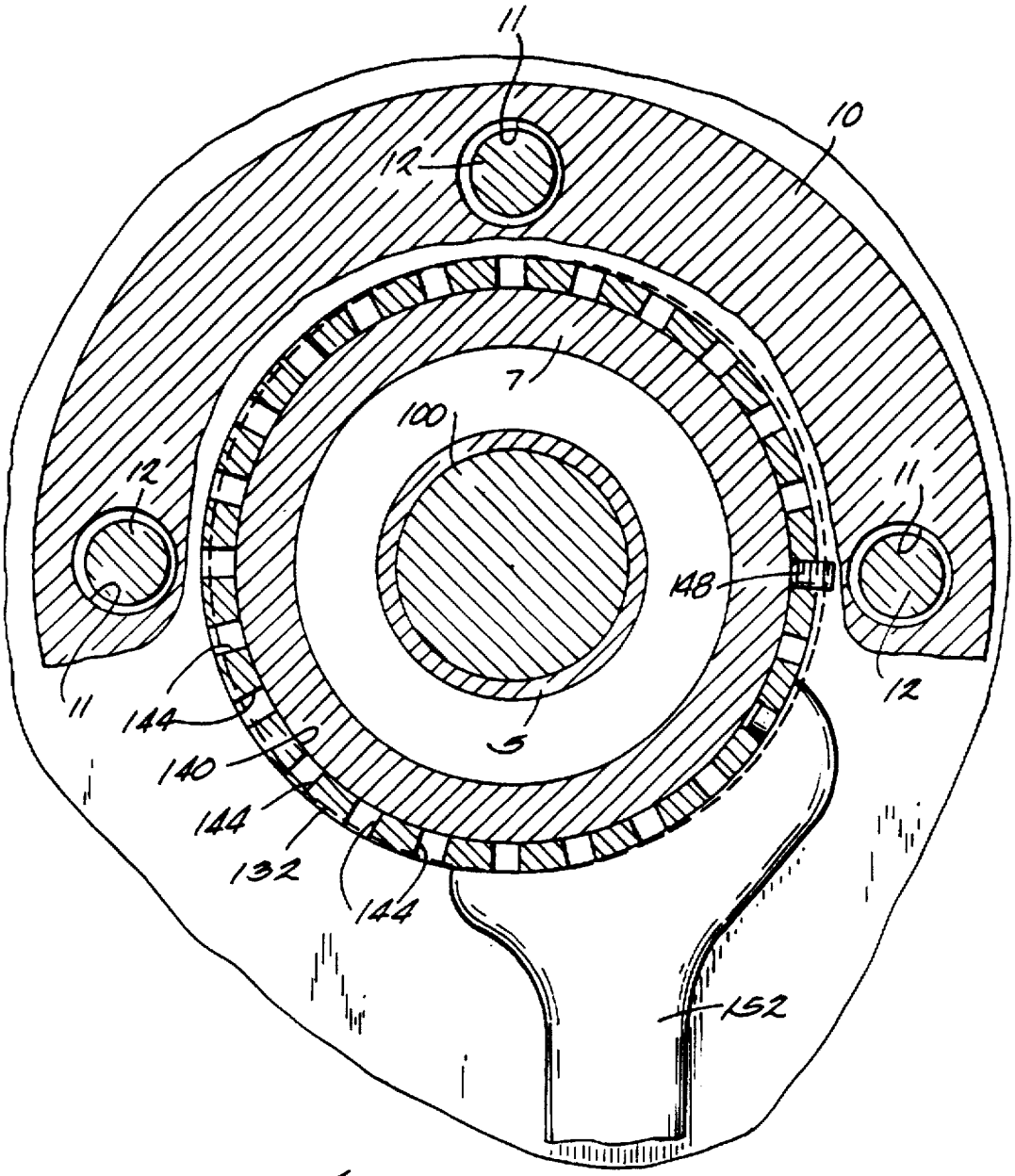
FIG. 4 is a view taken generally along line 4—4 in FIG. 3.

A wheel assembly including the idler wheel 56 is illustrated in FIGS. 3 and 4. The wheel 56 is mounted on an axle 100 having a central or rotation axis 104. The axle 100 is supported relative to the frame 16, and specifically the end truck 26, by two capsule bearing assemblies 108 and 112. The bearing assemblies 108 and 112 are mirror images of each other, and only the assembly 108 will be described in detail. Common elements have been given the same reference numerals.

The bearing assembly 108 includes a capsule bearing 116. Except as described below, the capsule bearing 116 is identical to the prior art bearing 4 described above, and common elements have been given the same reference numerals. The outer member 7 differs from the prior art outer member in that the cylindrical outer surface 8 has a smaller diameter, for reasons explained below.

Figures 2, 5:
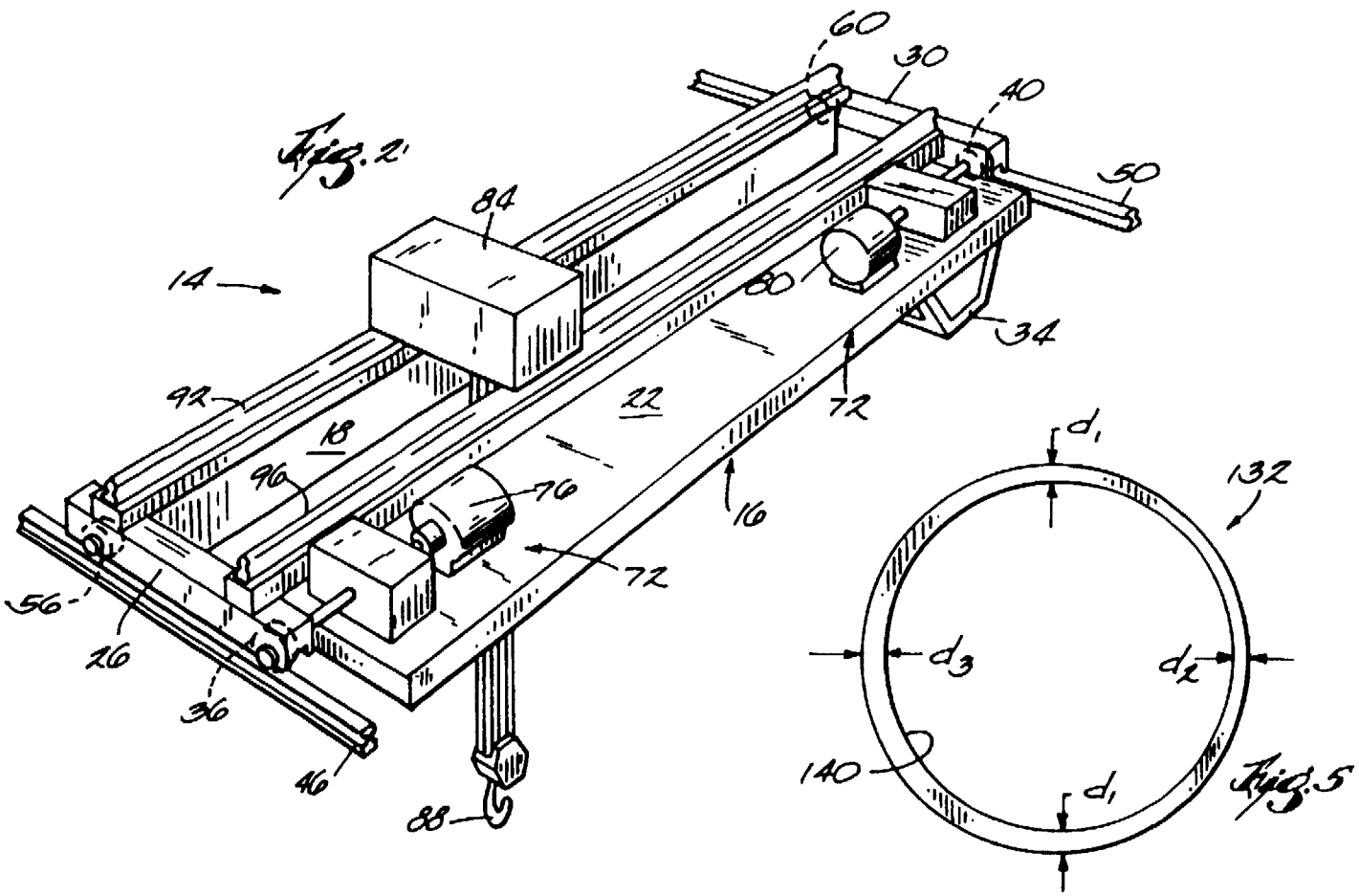
FIG. 2 is a perspective view of an overhead crane embodying the invention.
FIG. 5 is an end view of the sleeve taken along line 5—5 in FIG. 3.

The bearing assembly 108 also includes mounting means for mounting the bearing 116 on the frame 16 so that the position of the rotation axis 104 is adjustable relative to the frame 16. Preferably, the mounting means includes a mechanism 120 connecting the bearing 116 to the frame 16 and allowing the rotation axis 104 to be fixed in various positions relative to the frame 16. In the illustrated construction, the frame 16 has a cylindrical inner surface 124 defining a cylindrical opening in the frame 16, and the mechanism 120 includes a sleeve 132 housed in the frame opening. The sleeve 132 has a cylindrical outer surface 136 abutting the frame inner surface 124, and the sleeve 132 has therein an eccentric opening 140 (FIGS. 4 and 5). In other words, the center of the outer surface 136 and the center of the opening 140 are offset. In the illustrated construction, the offset is 0.06 inch. Consequently, while the sleeve 132 has a thickness $d_1$ of 0.38 inch on the top and bottom as shown in FIGS. 4 and 5, the sleeve 132 has a thickness $d_2$ of 0.32 inch thick on one side (the right side in FIGS. 4 and 5), and has a thickness $d_3$ of 0.44 inch thick on the other side (the left side in FIGS. 4 and 5). The sleeve opening 140 houses the bearing 116, i.e., the outer surface 8 of the bearing member 7 abuts the inner surface of the sleeve 132. As a result, rotation of the sleeve 132 relative to the frame 16 moves the rotation axis 104 relative to the frame 16. Rotation of the sleeve 180 degrees from the position shown in solid lines in FIG. 4 to the position shown in phantom in FIG. 4 moves the axis 0.12 inch to the right. Between these two extreme positions, the rotation axis 104 is adjustable in an infinite number of position.

The sleeve 132 has therein (see FIG. 4) a plurality of circumferentially-spaced, radially extending holes 144. Four of these holes 144, preferably spaced ninety degrees apart, are adapted to threadedly receive respective set screws 148 (one is shown in each of FIGS. 3 and 4) for releasably securing the sleeve 132 relative to the bearing 116. The remainder of the holes 144 are engageable with a tool, such as a spanner wrench 152 (shown only in FIG. 4), for rotating the sleeve 132 relative to the frame 16.

The mounting means also includes means for fixedly securing the bearing 116 relative to the frame 16. Preferably, this means includes the bolts 12. The outer member 7 differs from the prior art outer member in that the holes 11 have a larger diameter. The holes 11 are large enough in diameter to accommodate movement of the bearing 116 relative to the frame 16, and thus movement of the bolts 12 relative to the bearing 116, in response to rotation of the sleeve 132. Preferably, as shown in FIG. 3, flat washers 156 (rather than lock washers) are used between the bolt heads and the bearing flange.

The prior art capsule bearing is retrofitted as follows. The pilot diameter (the diameter of the outer surface 8 of the outer member 7) is reduced, in the preferred embodiment by approximately 0.76 inch. Also, the mounting holes 11 in the outer member flange are enlarged, in the preferred embodiment by approximately 0.19 inch. The sleeve 132 is placed over the outer member 7 and then the outer member 7 is fixed to the frame 16 with the sleeve 132 housed in the frame opening. The bolts 12 are inserted but not fully tightened. As explained above, the spanner wrench is used to rotate the sleeve 132 relative to the frame until the bearing 116 is properly positioned relative to the frame. When the bearing is in the desired position, the bolts 12 are fully tightened. At least two of the set screws 148 should be tightened to secure the sleeve 132 relative to the bearing 116.

Various features of the invention are set forth in the following claims.

I claim:

1. An overhead crane adapted to be supported on a pair of spaced apart, generally parallel first and second rails, the crane comprising a frame having opposite first and second ends, the first end of the frame including a first cylindrical frame surface defining a first cylindrical opening, and the second end of the frame including a second cylindrical frame surface defining a second cylindrical opening, a first wheel rotatably mounted on the first end of the frame, the first wheel being adapted to roll along the first rail, a second wheel rotatably mounted on the second end of the frame, the second wheel being adapted to roll along the second rail, a first bearing assembly supporting the first wheel, a second bearing assembly supporting the second wheel, the first bearing assembly including a first bearing supporting the first wheel for rotation relative to the frame about a first rotation axis, the first rotation axis having a position relative to the frame, and first mounting means for mounting the first bearing on the frame so that the position of the first rotation axis is adjustable relative to the frame in an infinite number of positions between two extreme positions, the first mounting means including a first sleeve housed in the first cylindrical opening in the frame, the first sleeve having therein an eccentric opening housing the first bearing, such that rotation of the first sleeve relative to the frame moves the first rotation axis relative to the frame, the second bearing assembly including a second bearing supporting the second wheel for rotation relative to the frame about a second rotation axis, the second rotation axis having a Position relative to the frame, and second mounting means for mounting the second bearing on the frame so that the position of the second rotation axis is adjustable relative to the frame in an infinite number of positions between two extreme positions, the second mounting means including a second sleeve housed in the second cylindrical opening in the frame, the second sleeve having therein an eccentric opening housing the second bearing, such that rotation of the second sleeve relative to the frame moves the second rotation axis relative to the frame, a hoist supported by the frame, and a load engaging mechanism which is raised and lowered by the hoist.

2. A crane as set forth in claim 1 wherein the bearing has therein a plurality of holes each having extending therethrough a respective fastener for fixedly securing the bearing to the frame.

3. A crane as set forth in claim 1 and further comprising at least one set screw for releasably securing the sleeve relative to the bearing.

4. A crane as set forth in claim 1 wherein the sleeve has therein at least one aperture for engagement with a tool for rotating the sleeve relative to the frame.

5. A crane as set forth in claim 1 and further comprising motor means mounted on the frame and drivingly connected to the first and second wheels.

6. A crane as set forth in claim 5 wherein the motor means includes a first motor mounted on the frame and drivingly connected to the first wheel, and a second motor mounted on the frame and drivingly connected to the second wheel.

7. A crane as set forth in claim 1 wherein the hoist is moveable along the frame in a direction generally perpendicular to the rails.

8. A crane as set forth in claim 1 wherein the bearing has therein a plurality of holes each having extending therethrough a respective fastener for fixedly securing the bearing to the frame, each of the holes being large enough to accommodate movement of the respective fastener relative to the bearing in response to adjustment of the position of the rotation axis.

9. An overhead crane adapted to be supported on a pair of spaced apart, generally parallel first and second rails, the crane comprising a frame having opposite first and second ends, the first end of the frame including a cylindrical frame surface defining a cylindrical opening, a first wheel rotatably mounted on the first end of the frame, the first wheel being adapted to roll along the first rail, a second wheel rotatably mounted on the second end of the frame, the second wheel being adapted to roll along the second rail, a first bearing assembly supporting the first wheel, a second bearing assembly supporting the second wheel, the first bearing assembly including a bearing supporting the first wheel for rotation relative to the frame about a rotation axis, the rotation axis having a position relative to the frame, the bearing having therein a plurality of holes each having extending therethrough a respective fastener for fixedly securing the bearing to the frame, and a mechanism connecting the bearing to the frame and allowing the bearing to be fixed in various positions relative to the frame, the mechanism including a sleeve housed in the cylindrical opening in the frame, the sleeve having therein an eccentric opening housing the bearing, such that rotation of the sleeve relative to the frame moves the rotation axis relative to the frame, a hoist supported by the frame, and a load engaging mechanism which is raised and lowered by the hoist.

10. A crane as set forth in claim 9 and further comprising at least one set screw for releasably securing the sleeve relative to the bearing.

11. A crane as set forth in claim 9 wherein the sleeve has therein at least one aperture for engagement with a tool for rotating the sleeve relative to the frame.

12. A crane as set forth in claim 9 and further comprising motor means mounted on the frame and drivingly connected to the first and second wheels.

13. A crane as set forth in claim 12 wherein the motor means includes a first motor mounted on the frame and drivingly connected to the first wheel, and a second motor mounted on the frame and drivingly connected to the second wheel.

14. A crane as set forth in claim wherein the first and second wheels are drive wheels, and further comprising a first idler wheel rotatably mounted on the first end of the frame, the first idler wheel being adapted to roll along the first rail, and a second idler wheel rotatably mounted on the second end of the frame, the second idler wheel being adapted to roll along the second rail.

15. A crane as set forth in claim 9 wherein the load engaging mechanism is a hook.

16. A crane as set forth in claim 9 wherein the hoist is moveable along the frame in a direction generally perpendicular to the rails.

17. A crane as set forth in claim 9 wherein each of the holes is large enough to accommodate movement of the respective fastener relative to the bearing in response to adjustment of the position of the rotation axis.

18. A method of aligning the wheel of a crane, the crane including a frame having therein a cylindrical opening, a wheel, and an original bearing supporting the wheel for rotation relative to the frame about a rotation axis, the original bearing having an outside diameter and normally being housed in the cylindrical opening the rotation axis having a position relative to the frame, the method comprising the steps of (a) providing a replacement bearing having an outside diameter less than the outside diameter of the original bearing, (b) providing a sleeve housed in the cylindrical opening in the frame, the sleeve having therein an eccentric opening housing the replacement bearing, and (c) rotating the sleeve relative to the frame so as to move the rotation axis relative to the frame.

19. A method as set forth in claim 15 and further comprising the step of releasably securing the sleeve relative to the bearing.

20. A method as set forth in claim 18 wherein step (c) includes using a tool for rotating the sleeve relative to the frame.

21. A method as set forth in claim 18 wherein step (a) includes providing the replacement bearing by reducing the outside diameter of the original bearing.

22. A method as set forth in claim 21 wherein the original bearing has therein a plurality of holes having extending therethrough respective fasteners for fixedly securing the original bearing to the frame, and wherein the method further comprises the steps of (d) before step (a), removing the fasteners from the holes and removing the original bearing from the cylindrical opening, (e) after step (d), enlarging the holes to accommodate movement of the fasteners relative to the replacement bearing in response to adjustment of the position of the rotation axis, and (f) after step (e), replacing the fasteners in the holes of the replacement bearing to the replacement bearing to the frame.

23. A method as set forth in claim 22 wherein step (f) is performed before step (c), and wherein step (c) is performed before the fasteners are fully tightened.

24. A method as set forth in claim 23 and further comprising the step of (g) after step (c), releasably securing the sleeve relative to the bearing.

25. A method as set forth in claim 24 wherein the sleeve is releasably secured relative to the bearing using set screws.

* * * * *

UNITED STATES PATENT AND TRADEMARK OFFICE

CERTIFICATE OF CORRECTION

PATENT NO. : 5,791,257
DATED : August 11, 1998
INVENTOR(S) : Jeffrey A. Konop

It is certified that error appears in the above-indentified patent and that said Letters Patent is hereby corrected as shown below:

Column 6, line 1, "as set forth in claim" should be
--as set forth in claim 12--

Column 6, line 33, "as set forth in claim 15" should be
--as set forth in claim 18--

Signed and Sealed this

Fourth Day of May, 1999

*Attest:*

Q. TODD DICKINSON

*Attesting Officer*

*Acting Commissioner of Patents and Trademarks*